United States Patent [19]

McPhee

[11] 4,428,440

[45] Jan. 31, 1984

[54] PERFORATING APPARATUS ENERGY ABSORBER AND EXPLOSIVE CHARGE HOLDER

[75] Inventor: William A. McPhee, Houston, Tex.

[73] Assignee: Dresser Industries, Inc., Dallas, Tex.

[21] Appl. No.: 292,969

[22] Filed: Aug. 14, 1981

[51] Int. Cl.[3] ..... E21B 43/17

[52] U.S. Cl. ..... 175/4.6; 175/4.56; 102/310

[58] Field of Search ..... 102/306, 307, 308, 309, 102/310; 175/4.53, 4.56, 4.6

[56] References Cited

U.S. PATENT DOCUMENTS

| | | | |
|---|---|---|---|
| 2,980,017 | 4/1961 | Castel | 102/310 |
| 3,346,057 | 10/1967 | Bell | 175/4.6 |
| 3,739,723 | 6/1973 | Hakala | 175/4.6 |
| 3,773,119 | 11/1973 | Shore | 175/4.6 |
| 3,965,993 | 6/1976 | Lavigne et al. | 102/310 |
| 4,071,096 | 1/1978 | Dines | 175/4.6 |
| 4,312,273 | 1/1982 | Camp | 175/4.6 |
| 4,326,462 | 4/1982 | Garcia et al. | 175/4.6 |
| 4,371,044 | 2/1983 | Willig et al. | 175/4.6 |

*Primary Examiner*—Stephen J. Novosad
*Assistant Examiner*—William P. Neuder
*Attorney, Agent, or Firm*—Richard M. Byron; Patrick H. McCollum

[57] ABSTRACT

In a perforating apparatus which has a plurality of explosive charges contained in an elongated tubular perforating gun body and supported on a carrier an energy absorber and explosive charge holder are provided by the present invention. The carrier extends longitudinally in the gun body and has the cases of the explosive charges mounted therethrough with a detonating cord or prima cord positioned at the detonating end portion of the several explosives charges. The energy absorber and explosive charge holder comprises a shaped metallic shield that grasps sides of an explosive charges case to secure it in a rigid fixed position on the carrier. An aperture in this shield permits passage of the detonating cord over the detonating end portion of the charge case and retention of it at that location. The shield encircles the detonating end portion of the explosive charge case and covers sides of the case such that upon detonation of the explosive charge laterally directed energy from the growth of the explosion is absorbed by the shield.

5 Claims, 3 Drawing Figures

PERFORATING APPARATUS ENERGY ABSORBER AND EXPLOSIVE CHARGE HOLDER

TECHNICAL FIELD

This invention is related to oilfield perforators that have a plurality of explosive charges mounted within a perforating gun body. More particularly, this invention is related to an energy absorbing device used in an oilfield perforator gun body to lessen physical damage to the gun body upon detonation of the charge. The invention is also related to a device for securing the case of an explosive charge to the carrier in an oilfield perforator.

BACKGROUND OF THE INVENTION

One type of oilfield perforator that is in common use comprises an elongated tubular perforating gun having a plurality of laterally directed explosive shaped charges or shaped charges mounted at longitudinal spaced intervals on a carrier that is contained within the perforating gun body. The carrier positions the explosive charges within the gun body so that outlets of the shaped charges are directed laterally of the gun body. The gun body is a cylindrical member designed to withstand the significant explosive forces produced by the detonation of the explosive shaped charges and permit energy of the shaped charges to leave the gun body at selected locations.

In using this type of perforating equipment several common and well recognized problems appear. When the perforating gun is detonated the individual explosive charges are exploded and due to their design a significant thrust of their individual explosions passes through the associated ports in the gun body. However, a significant portion of this explosive force remains within the perforating gun body. If this force is excessively large it can cause excessive swelling, fracturing and/or severing of the gun body into two or more pieces. This is undesirable because fragments of the gun body and perforating equipment must be separately extracted from the well that has been perforated and this can be exceedingly difficult and time consuming. If this contained explosive force is less substantial it can cause some radial swelling of the perforating gun body. This swelling can be tolerated within limits in view of removing the perforating gun body from the well after the perforating operation.

Overcoming the two above described well known problems associated with oilfield perforating often involves a compromise in the gun body design and the strength of the explosive charge used. This compromise is one which will provide a maximum penetration of the perforation into the earth's formation which requires a greater effectiveness of the explosive while at the same time keeping the explosives charge small enough so that the gun body is not excessively swollen or fractured upon detonation of the explosives.

SUMMARY OF THE INVENTION

An embodiment of the perforating apparatus energy absorber and explosive charge holder of this invention includes a blast retainer or shield that substantially surrounds the detonating end portion of an explosive charge mounted on a carrier and contained within a hollow tubular perforating gun body. The blast retainer or explosive charge shield is constructed to grasp opposed sides of the case of an explosive shaped charge a secure the case in an substantially fixed position on a carrier. The carrier is used for positioning the explosive shaped charge within the perforating gun body. The blast retainer or explosive charge shield is constructed such that it retains the detonating cord or prima cord in a fixed position at the detonating end portion of the explosive shaped charge. When the explosive shaped charge is detonated, opposed sides of this shield absorb a portion of the energy radiating or growing laterally from the explosion in order to lessen the effectiveness of this energy of the interior of the perforating gun body at that location.

One object of this invention is to provide a perforating apparatus energy absorber and explosive charge holder overcoming the aforementioned disadvantages of the prior art perforators.

Still, another object of this invention is to provide an energy absorbing structure for use in oilfield perforators that have a plurality of explosive charges mounted within a perforating gun body so that explosive energy contained within the gun body does not cause excessive swelling fracture or segmentation of the gun body.

Still, another object of this invention is to provide a retainer for securing explosive shaped charges in a supportive carrier of an oilfield operator.

Yet, another object of this invention is to provide an easily installed explosive charge holder that positions a detonating or prima cord in a fixed position at the detonating end portion of an explosive shaped charge of an oilfield perforator.

Various other objects, advantages and features of this invention will become apparent to those skilled in the art from the following discussion, taken in conjunction with the accompanying drawings in which:

Figure 1:
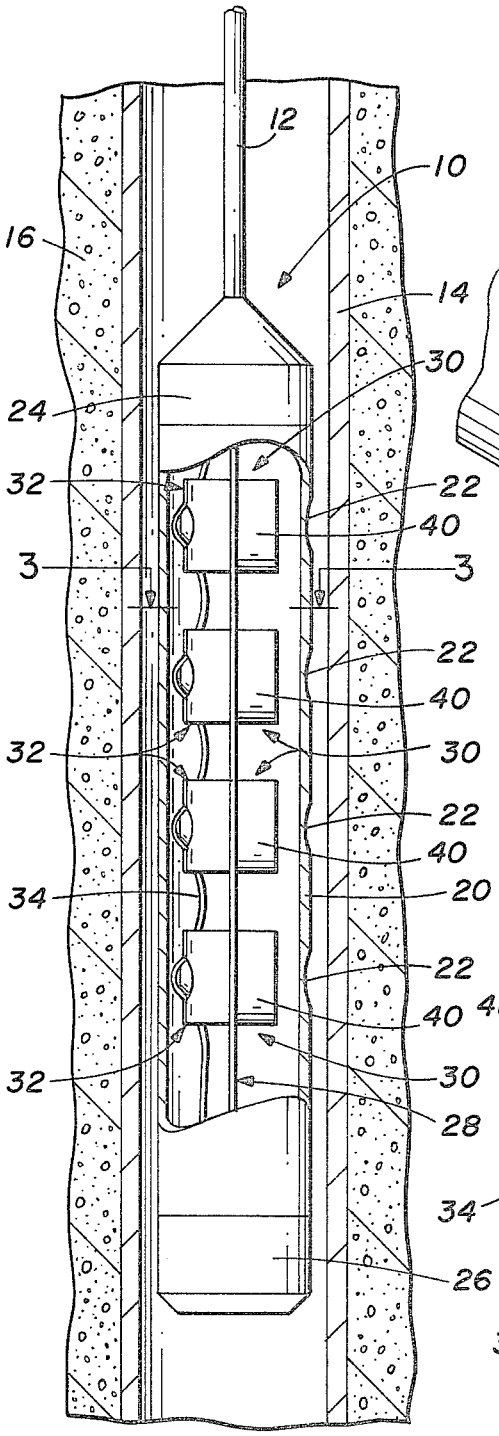
FIG. 1 is a pictorial representation of an earth borehole segment with casing cemented therein and an oilfield perforator suspended within the well segment wherein portions of the perforating apparatus are cut away exposing the interior thereof.

The following is a discussion and description of preferred specific embodiments of the perforating apparatus energy absorber and explosive charge holder of this invention, such being made with reference to the drawings whereupon the same reference numerals are used to indicate the same or similar parts and/or structure. It is to be understood that such discussion and description is not to unduly limit the scope of the invention.

DETAILED DESCRIPTION OF THE PREFERRED EMBODIMENT

Referring to the drawings in detail and in particular to FIG. 1 such shows a segment of a cased well having a perforating apparatus, indicated generally at 10, suspended therein by a cable 12. As illustrated the well includes a borehole through the earth formation within which a string of casing 14 is secured by cement 16.

Perforating apparatus 10 includes a typical thick walled tubular gun body 20 having a plurality of longitudinally spaced thin sidewall segments 22 therethrough. Perforating gun body 20 is attached to electrical cable 12 by a cable head assembly 24 at the upper end portion thereof. A lower closure member 26 is removably mounted at the lower end portion of perforating gun body 20. Within the perforating apparatus a carrier 28 has a plurality of explosive shaped charges mounted in a longitudinally spaced relation therethrough. Each of the explosive shaped charges 30 has an energy absorber or explosive charge holder 32 positioned in surrounding relation to the detonating end portion thereof. In the following discussion the energy absorber and explosive charge holder will be referred to as an explosive charge shield 32. A detonating cord or prima cord 34 extends between the detonating end portions of the plurality of explosive shaped charges and it is held in place by explosive charge shield 32. Prima cord 34 is also connected to a detonator (not shown) contained in perforating apparatus 10 as is well known to those skilled in the art.

Figure 2:
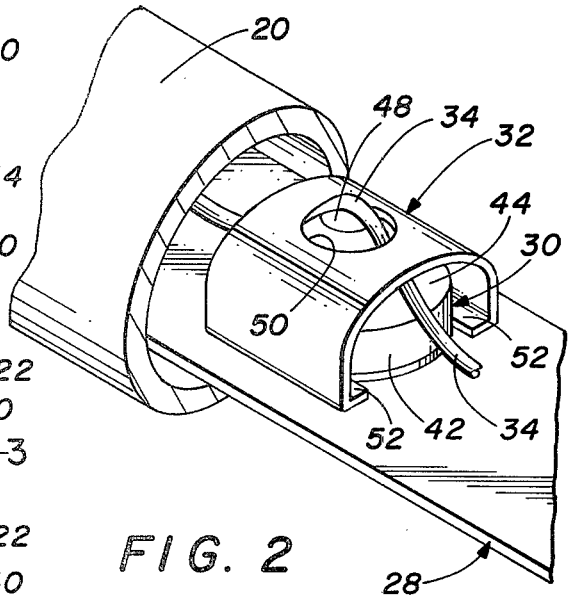
FIG. 2 is a perspective view of a portion of a perforator gun body with the explosive charge carrier extending therefrom and having an explosive shaped charge mounted therewith by the explosive charge holder of this invention.
Figure 3:
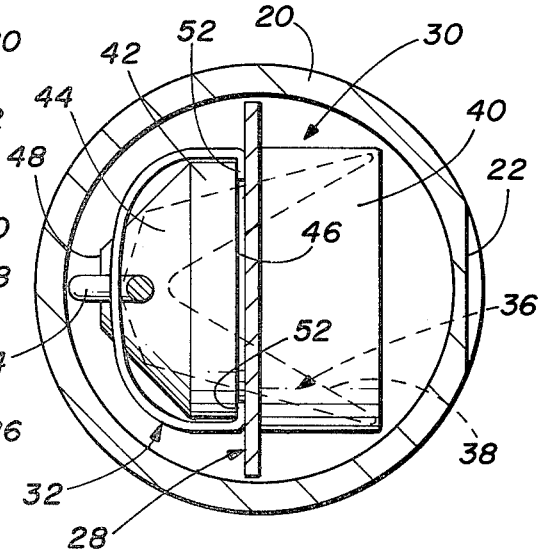
FIG. 3 is a cross sectional view of an oilfield perforator taken transversely through the gun body and looking longitudinally through the interior thereof toward an explosive shaped charge mounted on a carrier and secure by the energy absorber and explosive charge holder of this invention.

FIGS. 2 and 3 show an explosive shaped charge in its mounted configuration with the explosive charge shield 32. Each of the explosive shaped charges are constructed indentically with a charge case formed of a yieldable metallic material and containing an explosive pellet 36 and a charge liner 38 as is well known in the art. The case includes a generally circular cylindrical discharge portion 40 on what is the discharge side of the explosive shaped charge. The detonation end portion of the case includes a generally cylindrical segment 42 being smaller in diameter than cylindrical discharge end domed portion 40 and extending therefrom to a frustoconically shaped portion 44. A locking recess or groove 46 is provided in the case at the juncture of cylindrical discharge end portion 40 and smaller diameter cylindrical portion 42 in order to receive a portion of the explosive charge shield 32. The detonation end portion of the explosive shaped charge is terminated at an end surface 48 of the frustoconically shaped case portion 44 adjacent to the apex end portion of the explosive shaped charge. Prima cord 34 is held in position over this end surface 48 by explosive charge shield 32 as shown in FIGS. 2 and 3.

Carrier 28 is an elongated planar member with a plurality of longitudinally spaced openings therethrough. Each of these openings are sized to receive the cases cylindrical portion 42 and contact a radial abutment at the juncture of case cylindrical portion 42 and cylindrical discharge end portion 40. The width of carrier 28 is sized to slip within the interior of gun body 20 and retain the plurality of explosive chaped charges in a substantially fixed position. Groove 46 in the case is spaced from the abutment in order to permit carrier 28 to be placed against the abutment and allow the mounting portion of explosive sharge shield 32 to engage groove 46 and secure the case in place on carrier 28.

Explosive charge shield 32 is constructed as shown in FIGS. 2 and 3. Explosive charge shield 32 has a generally U-shaped appearance when seen looking longitudinally of perforating gun body 20 as shown in FIG. 3. This shield is constructed of a width running longitudinally relative to the gun body which is substantially equal to the longitudinal dimension of explosive shaped charge 30 in the same direction. The width of explosive charge shield 32 can be less than the longitudinal dimension of the explosive shaped charge if desired. It has been found that with the shield being constructed of a width at least as or greater than the longitudinal dimension of the explosive shaped charge the invention will perform satisfactorily. In FIGS. 1 and 2 the width of this shield is shown to be greater than longitudinal dimension of explosive shaped charge 30. At the closed end portion of explosive charge shield 32 an aperture 50 is provided. Aperture 50 is sized such that it will pass the apex end portion of the case and prima cord 34 yet retain prima cord 34 in a deformed and compressed position substantially as illustrated with its overlying the cases apex end 48. At the open end portion of the explosive charge shield 32 a pair of inwardly directed flanges are provided with one flange extending inwardly toward the other in a facing relation from the associated sides of the shield. Flanges 52 are sized to fit within groove 46 around the perimeter of the case as illustrated. Because flanges 52 are retained in groove 46 and they extend beyond the case mounting aperture of carrier 28. They retain the case in a fixed mounted position on carrier 28.

Explosive charge shield 32 is preferably constructed of a metallic spring like material that is biased to a U-shaped configuration of a width between flanges 52 that is smaller than the lateral dimension of the case over which it will be mounted for use. Preferably the spring like action of this shield is sufficiently strong to hold the explosive charge case in place on the carrier 28 during assembly of the perforating apparatus and the positioning of it within a well. This is necessary to insure the explosive shaped charge is being properly oriented relative to the ports in perforating gun body 20 when the perforating apparatus is positioned for firing of the explosives in the well perforating operation. Additionally, the spring like action of explosive charge shield 32 is selected so that it is not unduly strong so as to prevent hand assembly of the perforating apparatus. This is important so that assembly, modifications and last minute preparations may be made by service technicians using this equipment as a wellsite. To assemble perforating apparatus 10 for use this includes placing the explosive shaped charges 30 in the carrier 28 by inserting the detonating end portion of the case through an aperture in carrier 28, then positioning prima cord 34 over the detonating end of the case and spreading explosive charge shield 32 by hand to slip over the apex end portion of the case to locate flanges 52 in locking position in groove 42 with prima cord 34 firmly held in place across the apex end 48 of the case.

When perforating apparatus 10 is in place in a well and ready for detonation it is oriented substantially as shown in FIG. 1. Depending upon the specific gun body and associated equipment within which the explosive charges are mounted in the gun body may be biased by other known apparatus that is not shown or described herein to a position with thin sidewall segments 22 against the interior of casing 14. Regardless of the orientation of perforating gun body 20 relative to the interior of the casing it will not significantly effect the operation or use of this invention. When a location to perforate the well casing has been selected and the necessary preparations made prima cord 34 is detonated by the detonator and this in turn detonates explosive shaped charges 30. Upon detonation of explosive shaped charges 30 the initial detonation occurs at the apex end portion of the case with the detonation wave front traveling toward the apex of charge liner 38. This wave front collapses the liner with the liner's inner surface disintegrating to form a portion of the jet stream. Further advancement of the wave front forms the jet stream which exits the perforating gun body 20 by passing through gun body thin sidewall segments 22 and forming openings in gun body 20. The outer surface of liner 38 forms a slug or carrot which follows the jet stream through the openings formed in thin sidewall segements 22. As this is occurring the explosion also travels in the direction of the detonation end portion of the explosive shaped charge. As the wave front from the detonation moves laterally outward from the apex portion of the explosive pellet 36 it causes a disintegration of the cases frusto conically shaped portion 44.

It has been found that the most damage done by portions of this case material is in the portions of the perforating gun body that lie laterally adjacent to the case closest to the interior of gun body 20. These portions of the case are covered by explosive charge shield 32 which resists this lateral movement of the case material and the explosive wave front by absorbing a portion of its energy in a spring like action. Because explosive charge shield 32 is constructed of spring like material and because it is biased generally toward the direction from which the explosive wavefront is originating a portion of the energy of the explosion is dissipated in deforming the shield. In use, explosive charge shield 32 is deformed to conform with the interior or perforating gun body 20 by the explosion. The deformation of this shield absorbs a portion of the energy from the explosion which would otherwise be transmitted in a unrestricted manner to the interior of perforating gun body 20. Because a portion of this energy is absorbed prior to reaching the interior of perforating gun body 20 the effect of the explosion on perforating gun body 20, is lessened in the areas where travel of the wave front from the explosion is decreased in intensity because of the shield.

In practice of this invention it has been found that during similar operating conditions for selected perforating gun body characteristics and explosive shaped charge characteristics the use of explosive charge shield 32 of this invention lessens the amount of physical damage done to perforating gun body 20 that would otherwise occur had the explosive charge shield not been used. In such findings it is noted that the principal damage sustained by a perforating gun body is in those zones located laterally adjacent to the detonation end portion of the explosive shaped charge. As described above damage to the perforating gun body can be either in the form of diametrically swelling or enlarging of the adjacent portions of gun body 20 or in a more severe case fracturing, fragmentation and separation of the gun body. Explosive charge shield 32 substantially encloses the portions of the case which if unrestricted would be most likely to cause damage to the perforating gun body upon detonation due to their closeness to the laterally interior surfaces of the perforating gun body.

In the use and operation of the energy absorber and explosive charge shield of this invention it is seen that same provides an easy and secure construction for retaining an explosive shaped charge in a carrier of an oilfield type perforator. The apparatus also provides an energy absorbing shield around portions of the explosive shaped charge case that will lessen the damage done to the perforating gun body upon detonation of the explosive shaped charge. The device has a beneficial effect of preventing such extensive damage to the perforating gun body that may render it difficult to remove from a well or require its removal in segments by a time consuming fishing or drilling activity. The explosive charge holder or shield 32 is simple in construction and adapted to hand assembly of a perforating apparatus in the field.

Although specific perferred embodiments of this invention have been described in detail in the preceding description this description is not intended to limit the invention to the particular form or embodiments disclosed herein since they are to be recognized as illustrative rather than restrictive and it would be obvious to those skilled in the art that the invention is not so limited. For example, the flange mounting arrangement of the explosive charge shield could be modified to be rigidly secured with the carrier and the cases of the explosive shaped charges by fasteners such as screws. Also the cases of the explosive charges could be modified to be mounted with the carrier by other structure such as fasteners or interlocking members or features on both members.

This invention is declared to cover all changes and modifications of the specific example of the invention herein disclosed for purposes of illustration. Such does not constitute departures from the spirit and scope of the invention.

The embodiments of the invention in which an exclusive property or privilege is claimed are defined as follows:

1. In a well perforating apparatus adapted for producing perforations in a well bore an apparatus having an elongated tubular perforating gun body within which is contained an explosive shaped charge with an external case mounted in a carrier such that the detonation end portion of the explosive shaped charge is located on one side of the carrier and the forward discharge end portion thereof is on the opposite side with said discharge end portion being larger in diameter than said detonation end portion and connected by an annular radial abutment that rests against said carrier for firing along a selected perforating axis transverse to said elongated tubular member and having a detonating cord positioned at the detonation end portion of the explosive shaped charge, an improvement comprising:

an explosive charge shield positioned in substantially surrounding relation to the major portion of the detonating end portion of said explosive charge with mount means securing said explosive charge shield in substantially rigidly mounted relation to said explosive shaped charge such that upon detonation of said explosive shaped charge a portion of the energy of the explosion is absorbed by said explosive charge shield as it is deformed in order to reduce the impact effects of the shaped charge's explosive forces on the perforating gun body;

said explosive charge shield has an aperture therethrough at the portion therof adjacent the detonating end portion of said explosive shaped charge case with a portion of said case detonating end portion extending through said aperture;

said well perforating apparatus includes a detonating cord positioned over the end of said detonating end portion and passed between the edge of said aperture and said detonating end portion of said case; and said mount means has a recess around said case discharge end portion spaced from said abutment and inwardly extending flange on each opposing end portion of said shield wherein said flanges are each cooperatively engaged in locking relation in opposed side portions of said recess and each flange contacts the side of said carrier on which said detonation end portion resides to secure said case to said carrier.

2. The explosive charge shield of claim 1, wherein:

said explosive charge shield is constructed of a resilient spring like material and formed in a generally transversely U-shaped member having longitudinally elongated sidewalls with inwardly facing flanges on each side at the opened end thereof and mounted with edge portions thereof engaged in said recess in said case and positioned to secure said explosive charge shield in a fixed position on such case to secure said case in a fixed position on said carrier.

3. A well perforating apparatus adapted for producing perforations in a well bore comprising:

(a) an elongated tubular perforating gun body;

(b) a plurality of explosive shaped charges each with an external case mounted in a carrier such that a detonation end portion of the explosive shaped charges is located on one side of the carrier and the forward discharge portion thereof is on the opposite side thereof and with said discharge end portion being larger in diameter than said detonation end portion and connected by an annular radial abutment that rests against said carrier such that said shaped charges are each positioned for firing along a selected perforating axis;

(c) a detonating cord positioned over the detonating end portion of said explosive shaped charges;

(d) an explosive charged shield positioned in substantially surrounding relation to the detonating end portion of each one of said explosive charges with a mount means securing said explosive charge shield in substantially rigidly mounted relation to said explosive shaped charge associated therewith such that upon detonation of said explosive shaped charge a portion of the energy of the explosion is absorbed by said explosive charge shield as it is deformed by explosive forces in order to reduce the effects of energy of the explosive forces on said perforating gun body;

(e) said explosive charge shield has an aperture therethrough at the portion thereof adjacent said detonating end portion of said explosive shaped charge with a portion of said case detonating end portion extending through said aperture and said detonating cord being positioned over the end of said detonating end portion and held in place between an edge defining said aperture and said detonating end portion of said explosive shaped charge; and (f) said mount means has a recess around said case discharge end portion spaced from said abutment an inwardly extending flange on each opposing end portion of said U-shaped shield wherein said flanges are each cooperatively engaged in locking relation in opposed side portions of said recess and each flange contacts the side of said carrier on which said detonation end portion resides to secure said case to said carrier.

4. The explosive charge shield of claim 3, wherein:

said explosive charge shield is constructed of a resilient spring like material and formed in a generally transversely U-shaped member having longitudinally elongated sidewalls with said inwardly facing flanges each side at the opened end thereof and mounted with edge portions thereof engaged in said recess in said case and positioned to secure said explosive charge shield in a fixed positioned on such case to secure said case in a fixed position on said carrier in order that upon detonation of said explosive charge said explosive charge shield will absorb a portion of the explosion shock wave moving outwardly from said explosive shaped charge.

5. Well perforating apparatus adapted for producing perforations in a well bore, comprising:

(a) an elongated tubular perforating gun body;

(b) a plurality of explosive shaped charges, each having a case with a detonating end portion and a forward discharged end portion (c) a carrier having mounted thereon said plurality of explosive shaped charges such that the detonation end portion of each of said explosive charges is located on one side of said carrier and the forward discharge end portion thereof is located on the opposite side thereof;

(d) each of said shaped charges has said discharge end portion being larger in diameter than said detonation end portion and connected by an annular radial abutment that rests against one side of said carrier, and each of said shaped charges additionally having a recess around said case discharge end portion spaced from said abutment by an amount slightly greater than the thickness of said carrier;

(e) a detonation cord extends through said gun body and is positioned at said detonating end portion of each of said shaped charges;

(f) an explosive charge shield positioned in substantially surrounding relation to said detonating end portion of each of said explosive shaped charges and constructed of a resilient spring like material and formed into a generally transversely U-shaped member having longitudinally elongated sidewalls with inwardly facing flanges on each side at the open end thereof with said flanges mounted in opposed portions of said recess on opposed sides of said case adjacent to one side of said carriers and thereby positioned to secure said explosive charge shield in a fixed position on said case and to secure said case in a fixed position on said carrier; and (g) said explosive charge shields each have an aperture through the closed end portion thereof with said detonating end portion of the associated shaped charge extending therethrough and also having said detonating cord extending through said aperture and positioned in overlying relation to the detonating end portion of said case such that said detonating cord is held in a clamped and fixed position in relation to said case detonating end portion of said shaped charges in order that upon detonation of said explosive charge said explosive charge shield will absorb a portion of the explosion shock wave energy moving laterally from said explosive shaped charge thereby reducing the effects of such energy on the interior of said perforating gun body.

* * * * *